US007769478B2

(12) United States Patent
Zahornacky

(10) Patent No.: US 7,769,478 B2
(45) Date of Patent: Aug. 3, 2010

(54) SOUND SYSTEM AND METHOD FOR ELECTRIC MODEL TRAINS

(75) Inventor: Jon F. Zahornacky, Santa Clara, CA (US)

(73) Assignee: Lionel L.L.C., Chesterfield, MI (US)

( * ) Notice: Subject to any disclaimer, the term of this patent is extended or adjusted under 35 U.S.C. 154(b) by 1001 days.

(21) Appl. No.: 11/450,791

(22) Filed: Jun. 9, 2006

(65) Prior Publication Data

US 2007/0288109 A1 Dec. 13, 2007

(51) Int. Cl.
*G06F 17/00* (2006.01)
*G06F 15/177* (2006.01)
*A63H 19/14* (2006.01)

(52) U.S. Cl. ..... 700/94; 446/410; 713/2

(58) Field of Classification Search ..... 700/94; 446/175, 410, 467, 443; 713/1–2; 381/56, 381/58, 123

See application file for complete search history.

(56) References Cited

U.S. PATENT DOCUMENTS

| | | | | | |
|---|---|---|---|---|---|
| 5,174,216 | A * | 12/1992 | Miller et al. | ..... | 104/296 |
| 5,555,815 | A * | 9/1996 | Young et al. | ..... | 104/296 |
| 5,896,017 | A * | 4/1999 | Severson et al. | ..... | 312/280 |
| 5,973,596 | A * | 10/1999 | French et al. | ..... | 340/568.6 |
| 6,014,934 | A * | 1/2000 | Pierson | ..... | 105/26.05 |
| 6,281,606 | B1 * | 8/2001 | Westlake | ..... | 307/125 |
| 7,429,931 | B2 * | 9/2008 | Severson | ..... | 340/686.1 |

* cited by examiner

*Primary Examiner*—Vivian Chin
*Assistant Examiner*—Daniel R Sellers
(74) *Attorney, Agent, or Firm*—O'Melveny & Myers LLP

(57) ABSTRACT

An electronic sound chip stores digitized sounds. A PIC processor controls sound card operation, utilizing a free comparator present in the PIC processor that detects variable DC offsets, and thereby activates at least one "voice" or channel of sound. The system self-calibrates on the initial power on, and the calibration values are measured and stored internally in non-volatile storage for later comparison against the DC offset to frequency thresholds. The system detects loss of power, which mutes the audio during power interruptions for seamless model train direction control.

14 Claims, 5 Drawing Sheets

SOUND PROCESSOR

SOUND SYSTEM AND METHOD FOR ELECTRIC MODEL TRAINS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to electric powered models, for example, model trains and particularly to a low-cost sound system for model trains which comprises an electronic sound chip for storing digitized sounds with the sound chip containing a sound processor for producing sound from at least one of the voice channels in the sound chip, and a microprocessor for control; wherein the system uses a free comparator present in the microprocessor that controls sound card operation by detecting positive and negative DC offsets by voltage to frequency conversion and, thereby activating one of two "voices" or channels of sound, said offset detection system self-calibrates on the initial power on, and the calibration values are measured and stored internally in non-volatile storage for later comparison against the DC offset to frequency thresholds. The system detects loss of power, which mutes the audio during power interruptions for seamless model train direction control.

2. Description of Related Art Including Information Disclosed Under 37 CFR 1.97 and 1.98

Model train systems have been in existence for decades and during that time technology has advanced to allow hobbyists to enjoy more realistic model trains. Model train sound simulation systems have greatly benefited from technological advances. The earliest model train systems did not have sound simulation capabilities. Later, miniature whistles, horn, chuffing sounds, bells, and the like were added to imitate sounds that might be generated by a full-sized train. Digitized sound cards have become popular recently. Unfortunately, many digital model train sound systems have become increasingly expensive for the hobbyist.

The conventional prior art mode of operation is controlled by DC offsets on the AC track power. To trigger a horn, a positive DC offset is applied to the track. To trigger the Bell a negative DC offset is applied to the track. All other sounds are automatically triggered, as appropriate, except an external switch on the wheels controls the chuff cadence on the steamer version.

In conventional prior art operation, the power supply can "kick-back" a voltage pulse into the track as it loses regulation. This is common to the switching power supplies located on sound cards. This "kick-back" can trigger undesirable responses in the electronics in the locomotives the sound commander is located in and cause a failure of the locomotive to sequence direction properly because the locomotive direction control is managed by track power interruption. Before electronics entered into the direction control mechanisms, a solenoid advanced a pawl to reverse the motor connections and thus reversed the motor direction. As the locomotives advanced, the prior art devices now utilize electronics to perform this function. The electronics respond much faster than the mechanical reversing systems in these newer locomotives. This fast response time interprets the "kick-back" as 2 power interruptions; thus the prior art locomotive does not reverse direction correctly. To mitigate this, prior art technology uses a battery to supply power to the sound electronics at this critical time.

Several prior art methods have been used for detection of the positive and negative DC offset on the track. The simplest is an "integrator" or low pass filter. This filter converts the pulsing offset into a DC voltage to turn on a pair of transistors acting as switches for positive and negative offsets. These switches are used to activate the appropriate sound. This design is in the public domain and used by many sound cards in the market.

Lionel has a system in which a 324 op-amplifier is configured to oscillate at a nominal frequency. This frequency is driven higher or lower by the application of the DC offset to the amplifier, produced by the typical "integrator" described above. A sound processor that produces the sounds detects this frequency change to select the appropriate sound (horn or bell).

Prior art sound triggering in conventional mode uses simple Positive or Negative DC generation and detection. It is clear that this permits only 2 distinct sounds to be triggered. These are classified as horn and bell; or generically Sound #1 or Sound #2. QSI, a leader in sound system design, has utilized a "state-full" method of activating more than these 2 basic sounds. Their system is based on a sequence of "fast" pulses to select the sound.

For example: it takes about 0.4 second to fully develop an offset on the track to trigger a horn. This offset is about 3v to 5v DC. As the integrator charges, the voltage rises from 0v to the 3v to 5v range. If you apply this offset quickly, the voltage may only reach 2v before it subsides. The QSI system detects these lower voltages, which are not enough to trigger the Horn, and stores the detection of this signal. A series of pulses can pre-select a sound to be activated when the long pulse that creates the 3v to 5v offset. The products that do not detect these fast pulses ignore them as noise.

The prior art systems are overly complex and expensive.

U.S. Patent Application #20050152555, published Jul. 14, 2005 by Pierson, shows a sound system for a model vehicle and/or accessory which includes a control block configured to access predetermined digital data corresponding to a plurality of sound features. The control block is further configured to be responsive to at least one input signal indicative of at least a selected one sound feature to access the predetermined digital data and to generate a sound signal corresponding to the selected sound feature. The sound system further includes a current amplifier responsive to the sound signal configured to drive a speaker to produce the selected sound feature.

Two U.S. Patent Applications #20050023416 published Feb. 3, 2005 and #20040079841 published Apr. 29, 2004 both by Wolf et al., claim a model train operating, sound and control system that provides a user with increased operating realism. Remote control communication capability is provided between the user and the model trains. This feature is accomplished by using a handheld remote control on which various commands may be entered, and a Track Interface Unit that retrieves and processes the commands. The Track Interface Unit converts the commands to modulated signals in the form of data bit sequences (preferably spread spectrum signals) which are sent down the track rails. The model train picks up the modulated signals, retrieves the entered command, and executes it through use of a processor and associated control and driver circuitry. A speed control circuit located inside the model train that is capable of continuously monitoring the operating speed of the train and making adjustments to a motor drive circuit, as well as a novel smoke unit. Circuitry for connecting the Track Interface Unit to an external source, such as a computer, CD player, or other sound source, and have real-time sounds stream down the model train tracks for playing through the speakers located in the model train.

Two U.S. Pat. No. 6,624,537 issued Sep. 23, 2003 and U.S. Pat. No. 6,281,606 issued Aug. 28, 2001 both to Westlake, are for a plural output control station for operating electrical apparatus, such as model electric train engines and accessories. The control station employs a data processor for monitoring and controlling the signals generated at a plurality of transformer-driven power output terminals. An exemplary station includes two variable-voltage alternating current (AC) output channels (TRACK 1 and TRACK 2) and two fixed-voltage AC output channels (AUX 1 & AUX 2). The variable-voltage outputs are controlled by a data processor responsive to respective operator-controlled throttles for varying the AC output voltage and therefore the rate of movement and direction of electric train engines, typically three-rail O-gauge model trains. The variable-voltage outputs can also be offset by the data processor with positive and negative DC voltages for enabling engine functions such as horns, whistles and bells. The variable-voltage outputs are controlled by the data processor to also communicate control parameters to electric train engines for the operation and programming of various electric train engine features and accessories. The plurality of outputs are monitored by the data processor to ensure that predetermined voltage and/or current limits are not exceeded by any individual output and that a predetermined power limit is not exceeded by any individual output or by any combination of outputs.

Four U.S. Pat. No. 6,655,640 issued Dec. 2, 2003, U.S. Pat. No. 6,619,594 issued Sep. 16, 2003, U.S. Pat. No. 6,604,641 issued Aug. 12, 2003 and U.S. Pat. No. 6,457,681 issued Oct. 1, 2002 all to Wolf et al., show a model train operating, sound and control system that provides a user with increased operating realism. Remote control communication capability is provided between the user and the model trains. This feature is accomplished by using a handheld remote control on which various commands may be entered, and a Track Interface Unit that retrieves and processes the commands. The Track Interface Unit converts the commands to modulated signals in the form of data bit sequences (preferably spread spectrum signals) which are sent down the track rails. The model train picks up the modulated signals, retrieves the entered command, and executes it through use of a processor and associated control and driver circuitry. A speed control circuit located inside the model train that is capable of continuously monitoring the operating speed of the train and making adjustments to a motor drive circuit, as well as a novel smoke unit. Circuitry for connecting the Track Interface Unit to an external source, such as a computer, CD player, or other sound source, and have real-time sounds stream down the model train tracks for playing through the speakers located in the model train.

U.S. Pat. No. 6,616,505, issued Sep. 9, 2003 to Reagan, claims a model train sound board interface for making model trains compatible with the LIONEL TRAINMASTER® Command Control system. The model train sound board interface is comprised of circuitry which interprets serial digital data received from the LIONEL TRAINMASTER Command Control transmitter to determine what command the user is sending to the model train engine. Once the command is interpreted the circuitry provides the appropriate output signal to carry out the command. The circuitry of the preferred embodiment includes a microprocessor for interpreting serial data from the LIONEL TRAINMASTER Receiver, negative 5 and approximately negative 9 volt power supplies for providing consistent and filtered power to external sound boards, an H-bridge triac motor driver optically coupled to the microprocessor and DC offset circuitry made up of variable voltage regulators, again optically coupled to the microprocessor. The DC offset circuitry provides positive and negative DC offsets required by many popular aftermarket sound boards for model trains which provide life-like sound effects.

U.S. Pat. No. 5,174,216, issued Dec. 29, 1992 to Miller, describes a digital sound reproducing system for toy trains with stored digitized sounds recalled upon trackside triggering which produces a plurality of sound effects from digital data stored at predetermined addresses in a digital sound memory. A controller connected to the digital sound memory causes recall of a sound data from a predetermined sequence of addresses when triggered. This recalled sound data is converted into an analog audio signal for reproduction by a speaker. In a first embodiment the digital sound reproducing system is disposed in the car of a model train. Magnets disposed between the tracks trigger corresponding sound effects when the digital sound reproducing system detects passage of the magnets. A speed sensor detects the rotation rate of a wheel of the car to permit sound effects to be synchronous with the rate of speed of the model train. The digital sound reproducing system may alternately be disposed in a fixed structure and triggered by a command signal or by detection of passage of the model train. In a second embodiment, a detector indicates when a space may be occupied triggering a randomized sound sequence as background noise.

U.S. Pat. No. 5,555,815, issued Sep. 17, 1996 to Young, discloses a horn control system for model vehicles on a track that includes a sound generation unit mounted on the model vehicle which generates different sounds based on the combination of two inputs, the speed of the vehicle and an operator initiated horn signal. The type of sound is also preferably varied based on how long the horn button is depressed.

U.S. Pat. No. 5,754,094, issued May 19, 1998 to Frushour, indicates a sound generating apparatus for movable objects, particularly model trains, which generates audible sounds from digital signal representations of actual train sounds prestored in a memory mounted on the object. In one embodiment, the stored digital sound representations are divided into sets, with each set assigned to a different speed range of movement of the object. Each set includes a plurality of subsets, each containing distinct sound representations which can vary in volume and/or pitch. A central processing unit selects the appropriate set from the memory in response to the actual speed of movement of the object and randomly selects the subsets within the selected set as long as the object remains in a given speed range. In another embodiment, a single set is formed of a plurality of subsets. Each subset contains an identical number of sound representations which vary from subset to subset and within each subset in volume and/or pitch. The CPU randomly selects a sound representation from any of the subsets for each of plurality of consecutively generated sounds. Upon sensing speed variations, the CPU adjusts the length of the leader and/or tail end of each sound for faster or slower sound generation.

U.S. Pat. No. 5,773,939, issued Jun. 30, 1998 to Severson, puts forth command control for model railroading using AC track power signals for encoding pseudo-digital signals for transmitting very fast digital DC signals over the track for remote control in a model railroad layout, by selecting positive and negative lobes from the applied AC track power signal. This method allows digital transmission at 120 Hz rate that can be used within a 60 Hz AC system. This is fast enough to be used for Digital Command Control (DCC) and also capable of delivering large power output efficiently without the expense of filtering or exotic electronic control circuits. This method also has low sensitivity to electrical noise and does not generate significant noise during operation. Methods are described of transmitting and receiving positive and negative lobes and methods to extend this technology, and other areas where this technology can be applied such as remote control of appliances connected to any AC power environment such as home or industrial electric power systems.

U.S. Pat. No. 5,855,004, issued Dec. 29, 1998 to Novosel, concerns a sound recording and reproduction system for model train using integrated digital command control for recording, storing and reproducing sound for playing back in an environment requiring simulated sounds, voices, and/or sound effects. Sounds are recorded on a chip and played back in an asynchronous manner from the chip as a result of activation of a switch or inertial movement within the system. A Hall-effect sensor, reed switch or momentary switch or the like may be implemented for enabling activation of the recorded sound from the chip for broadcasting. A compander compresses the sound on the chip and expands the compressed sound for playback. Employing the above system for audio storage, a sound, motor and special effects controller may be created for model train applications as well. The different functions of the sound unit are controlled through a discrete bi-polar digital command control signal using a unique address for each unit. A synchronous means of play back may also be employed when the system is used with the bi-polar signal using a sensor. In addition to the analog sound storage, the same concepts and ideas may be applied to a digital sound recording and play back device as well.

U.S. Pat. No. 6,014,934, issued Jan. 18, 2000 to Pierson, illustrates a modular circuit board arrangement for use in a model train includes a motherboard mounted on the model train platform. The motherboard has receptacles that accept and communicate signals with a plurality of removable circuit modules for controlling model train operations. These circuit modules may include, for example, a light control circuit module and a sound control circuit module.

U.S. Pat. No. 5,896,017, issued Apr. 20, 1999 to Severson, is for a model train locomotive with a Doppler shifting of sound effects. Electronic circuits and methods are provided for remote control of a locomotive in a model railroad layout having an interruptible DC power supply coupled to the railroad track. The locomotive motor is isolated from the track so as to allow use of polarity reversals on the track power signal for controlling remote effects in the locomotive such as sound and visual effects. An on-board electronic state generator is provided in the locomotive for maintaining one at a time of a predetermined set of states, at least one of the states having a corresponding remote effect associated therewith. Remote control signals such as a pulsed reversal in polarity of the DC track power signal (PRP) or high voltage pulse (HVP) are used to clock the state generator to a desired state, thereby permitting control of a plurality of remote effects using only the traditional DC power supply interface. Further remote effects can be controlled by using the amount of DC voltage superimposed over the AC track signed to indicate, for instance, a desired pitch for the train horn. Alternately, the length in time at which a remote signal is applied to the track can itself serve as coded instructions to an on-board remote control selection memory.

U.S. Pat. No. 4,747,351, issued May 31, 1988 to Baret, provides a solid-state whistle and horn activation system for model railroads. An apparatus is shown for actuating a sounding device for model railroad engines powered by an alternating-current voltage impressed across two rails, which apparatus is completely solid state in nature. The system includes input and output transistors which are normally non-conducting together with means for producing a direct-current bias voltage for turning ON the input transistor when a direct-current bias voltage is superimposed on the alternating-current voltage impressed across the two rails. The input and output transistors are interconnected such that when the input transistor conducts so also does the output transistor to thereby power the sounding device.

What is needed is an inexpensive sound system for model trains.

BRIEF SUMMARY OF THE INVENTION

The primary object of the present invention is to provide an inexpensive sound system for model trains.

In brief, the Sound Commander of the present invention is a low cost sound system for AC electric trains. The Sound Commander of the present invention provides 2 "voices" or channels of digitized sound data. Digitizing software provided by the sound chip manufacturer programs these sounds into a blank sound chip. Typically sound systems provide for many sounds to promote realistic or "prototypical" behavior. The Sound Commander of the present invention has limited memory storage; therefore the sounds are limited in scope. Pricing the sound system in the marketplace will facilitate the limited sound set.

For diesels minimally, a horn, bell, and motor revolution effect are needed. Embellishments are brake compressor sounds and coupler clanks. Variations of horns, bells, and rev sounds are provided to represent the variety of locomotive power.

For steamers, the horn is replaced by a whistle, and the motor revolutions are replaced with steam hisses and chuffs.

An advantage of the present invention is that it calibrates automatically at initial power on in factory test.

Another advantage of the present invention is that it uses a free comparator present in the microprocessor to control sound card operation.

Another advantage of the present invention is a battery is not required for proper operation in conventional mode when sequencing directions.

Another advantage of the present invention is dynamic voice channel assignment (dynamic sound mapping™) for playing multiple sounds as often as possible.

Another advantage of the present invention is the ability to operate in conventional mode or in various command modes with serial data control streams or external trigger signals.

Another advantage of the present invention is the ability to change the sounds produced by removing the sound processor, which is in a socket, and replacing it with a newer version of a sound processor with different sounds.

Another advantage of the present invention is to respond to more then two sound commands in conventional mode using the Bell button for selection.

A further advantage of the present invention is that DC offset spikes caused by sparking power pickups may be filtered by algorithmic routines in the processor code, which are easy to change at any time by small changes to firmware, to accommodate varying environments.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
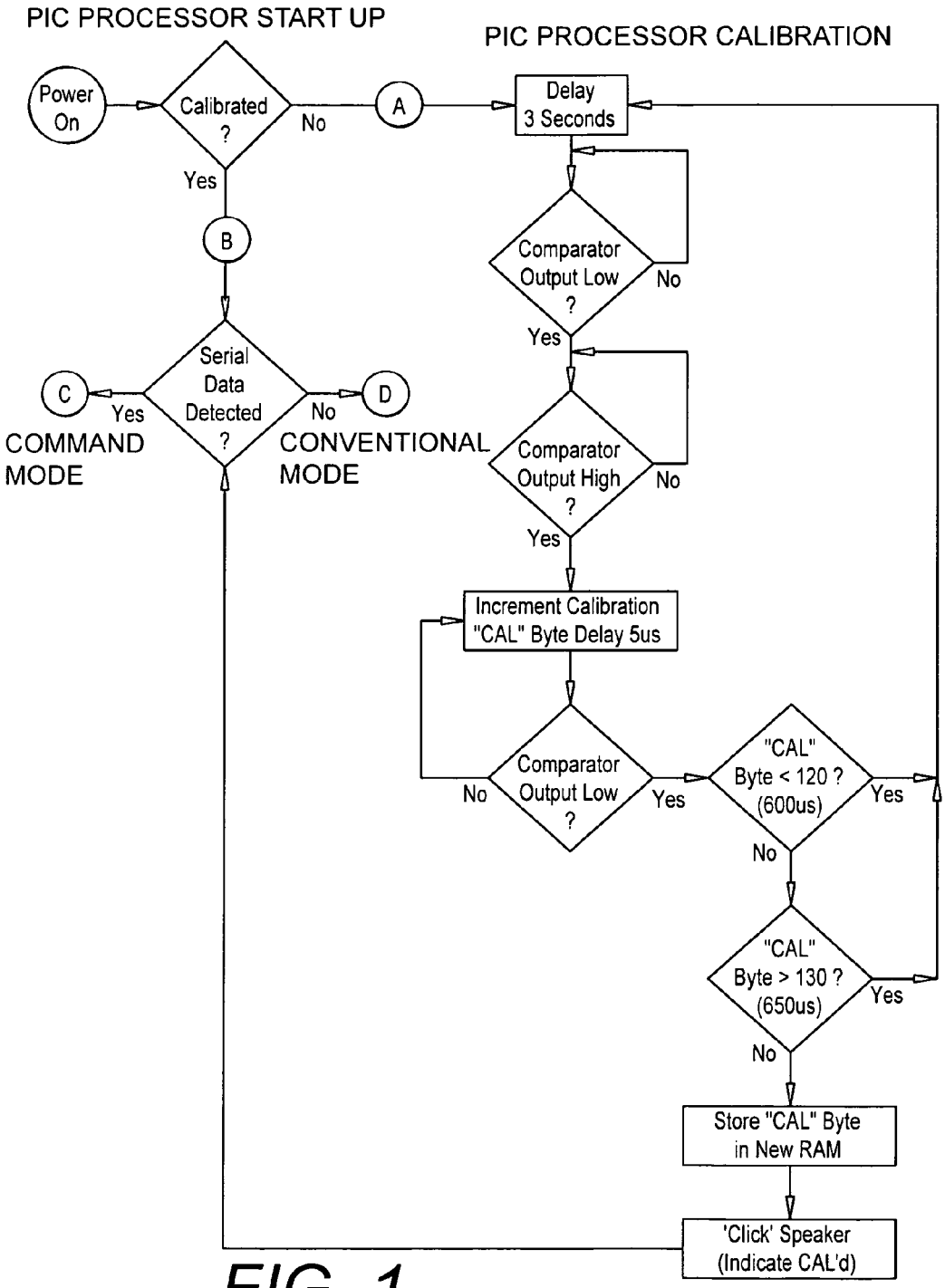
FIG. 1 is a flow chart diagrammatic view showing the steps of the start up and calibration of the PIC processor firmware.
Figure 2:
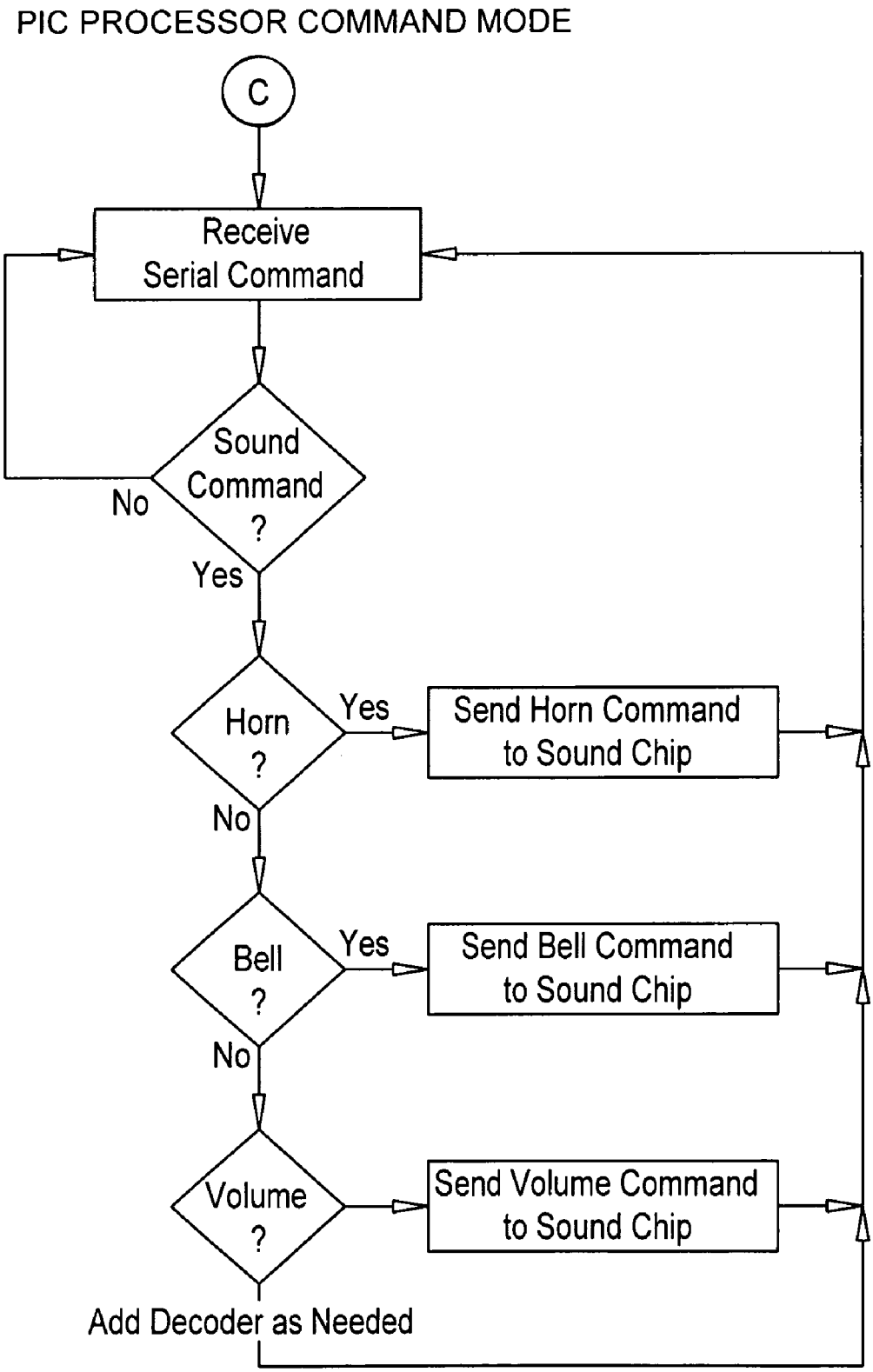
FIG. 2 is a flow chart diagrammatic view showing the steps of a "command mode" of operating the PIC processor firmware.
Figure 3:
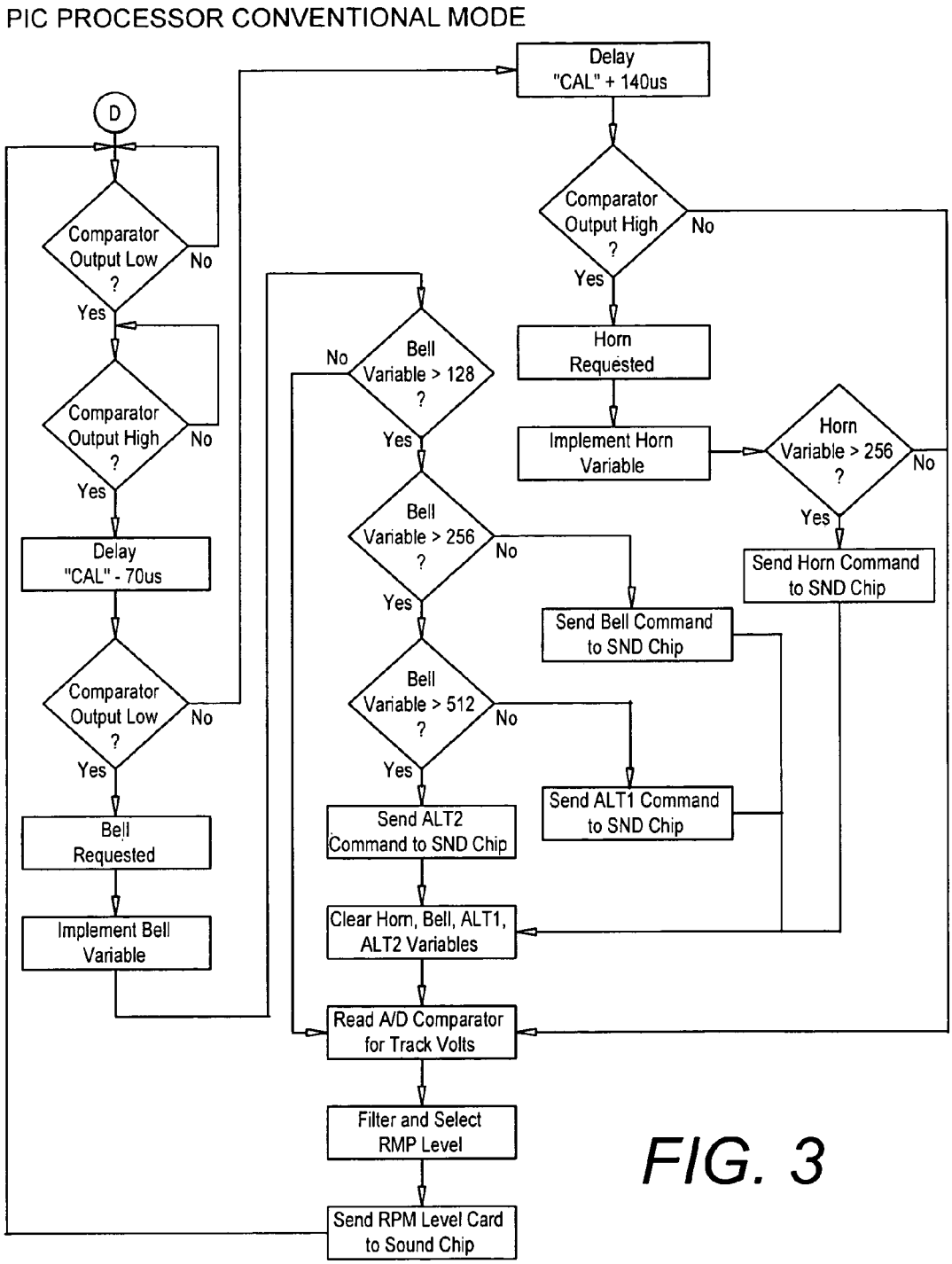
FIG. 3 is a flow chart diagrammatic view showing the steps of a "conventional mode" of operating the microprocessor firmware.
Figure 4:
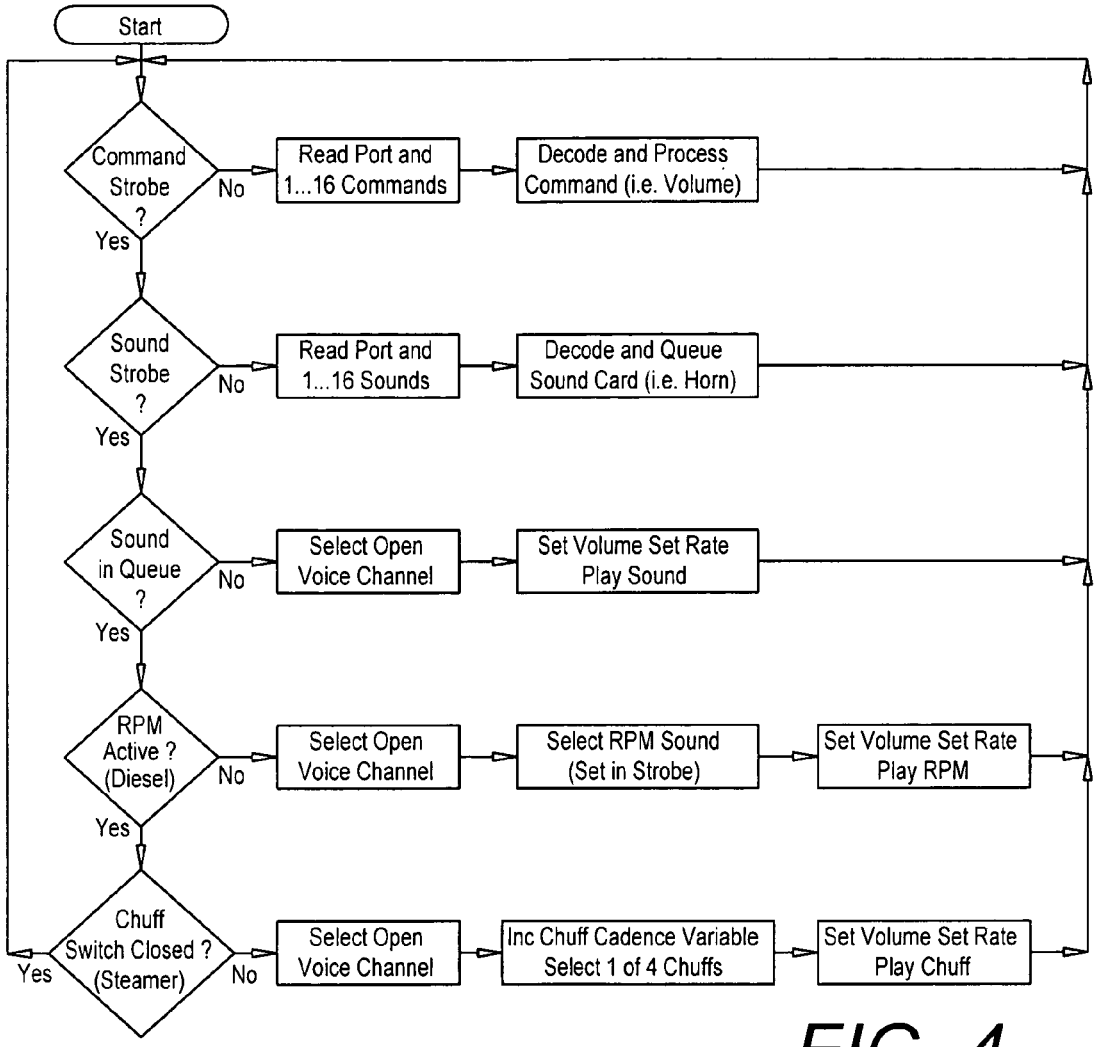
FIG. 4 is a flow chart diagrammatic view showing the steps of operating the sound processor firmware.
Figure 5:
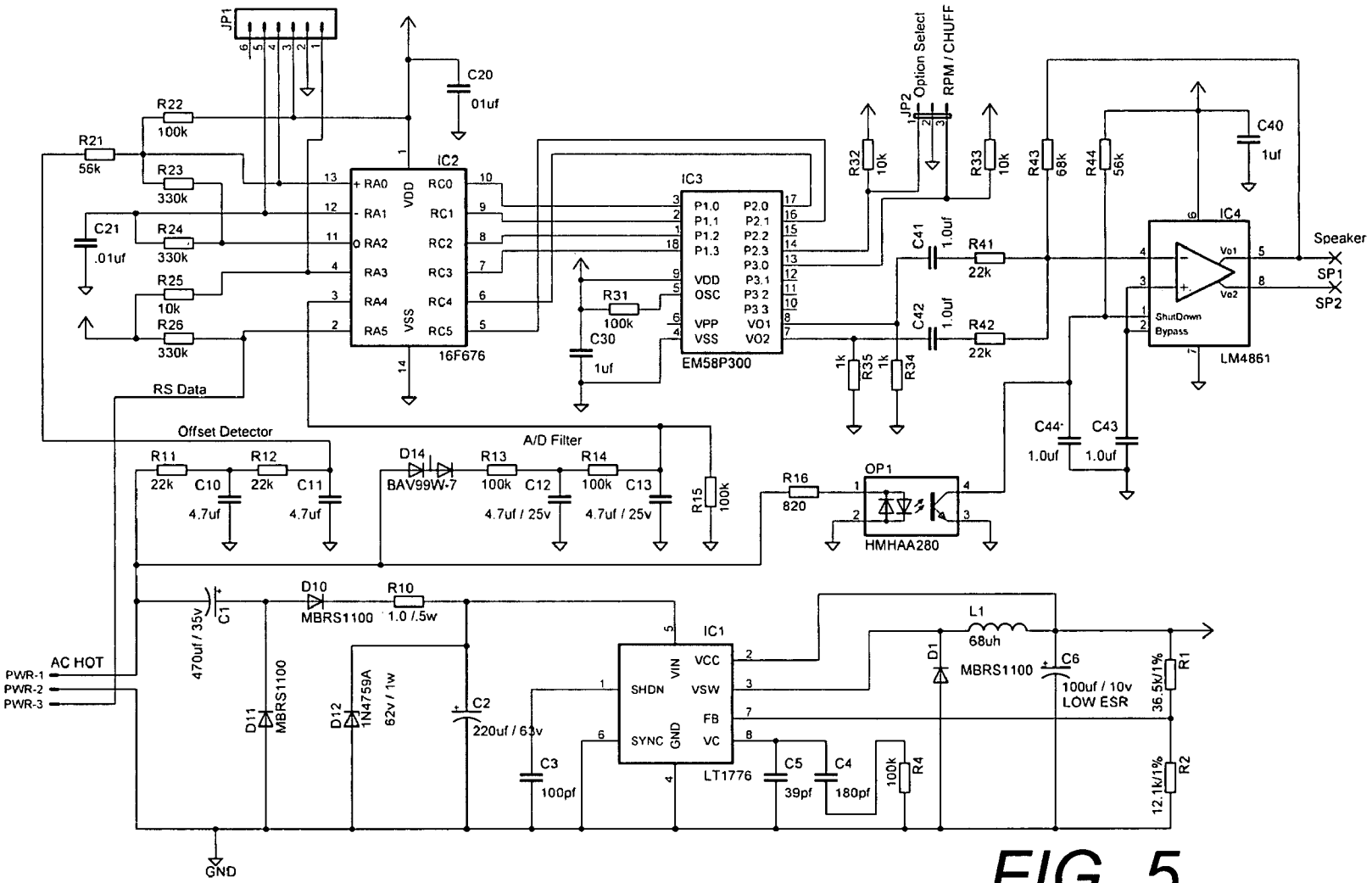
FIG. 5 is a diagrammatic view of the electronic components of the sound system of the present invention.

In FIGS. 1-5, a sound system for model trains comprises, diagrammed in FIG. 5, an electronic sound processor ("IC3") for storing digitized sounds and for producing sound from one of the voice channels; a microprocessor ("IC2") comprising a PIC processor having an internal comparator used as a voltage controlled oscillator present in the PIC processor, the PIC processor controlling sound chip operation; the comparator detecting variable DC offset frequencies input by a user and thereby activating one of the voice channels of sound in the sound chip, in which the PIC processor self-calibrates on an initial power on of the system, as indicated in FIG. 1, to measure the base frequency which is locked internally in a non-volatile storage for later comparison by the comparator against the DC offset to frequency thresholds. The PIC processor of the system works in a "command mode" as shown in FIG. 2, and a "conventional mode" as shown in FIG. 3, to send signals to the sound processor to produce the sounds, operating as shown in FIG. 4.

Processing of sound selection and playback is distributed between the PIC processor and the sound processor to distribute the resources between the two processors; a unique sound and control protocol between the two processors is used for communication to synchronize sound playback and control events.

The Opto-coupler ("OP1") shuts down a power amp ("IC4") to preserve power to allow main processing to remain operational in both the PIC processor and the sound processor and to resume sound generation after brief power interruptions to prevent kick-back that could create a malfunction of standard reversing electronics in locomotives.

The PIC processor measures track voltage with the "A/D filter" circuit to sequence the various rpm levels in a conventional mode, as shown in FIG. 3.

The PIC processor measures positive DC offset length with the "Offset Detector" circuit caused by user horn button activation length to repetitively play a s sound file to provide a horn or whistle of variable length by repeatedly issuing play commands to the sound processor while the positive DC offset is present.

The PIC processor measures a negative DC offset length with the "Offset Detector" circuit caused by user bell button activation length to measure the bell button release and select a sound based on the bell button activation length.

The PIC processor measures the same bell button activation length to activate a bell by normal bell button usage, which is less then 2 seconds.

The PIC processor calibrates a DC offset detector at power on one time to allow for variations of PIC processor production variables and component variables and places the calibration in non-volatile storage for subsequent operation.

The sound processor dynamically allocates voice channels to play as many concurrent sounds as possible in two channels to allow realistic sounds. If the rpm levels are on sound channel 2, and the bell is on sound channel 1, playing the horn would stop the bell, and blow the horn. If the rpm levels were silenced, the bell would be moved to sound channel 2, thus playing the horn on sound channel 1 would be concurrent.

The PIC processor adjusts the volume of each sound and stores the adjustment in a non-volatile storage in the PIC processor to tailor each sound to a pleasing volume. This volume setting is set on the sound processor at power on by the PIC processor.

In use, the sound producing method for model trains comprises using the PIC processor to control the electronic sound chip for storing digitized sounds, the sound chip containing a sound processor for producing sound from at least one of the voice channels in the sound chip, the PIC processor using an internal comparator used as a voltage controlled oscillator present in the PIC processor, the comparator detecting variable DC offset frequencies input by a user and thereby activating one of the voice channels of sound in the sound chip, in which the PIC processor self-calibrates on an initial power on, as indicated in FIG. 1, to measure the base frequency which is locked internally in a non-volatile storage for later comparison by the comparator against DC offset to frequency thresholds. The PIC processor of the system works in a "command mode" as shown in FIG. 2 and a "conventional mode" as shown in FIG. 3 to send signals to the sound processor to produce the sounds, operating as shown in FIG. 4.

In FIG. 1, the Present Invention Initializes as Shown.

The first time the power is applied to the system, the PIC processor looks for a calibration value. If not present, the system delays for 3 seconds for the comparator, operating as a voltage controlled oscillator, to stabilize. Then the base frequency of this oscillation is measured and locked in non-volatile storage. This calibration is done at the factory test, and there is no DC offset present during the calibration sequence. The calibration sequence is capable of locking onto the base frequency within +/−5 us of the nominal 1250 us rate. Once this calibration is completed, subsequent power up sequences proceed directly to operating mode. Normal operating mode is entered at "B", which involves looking for serial data present on the PIC "RS Data" line. If this serial data is present, the operation continues on FIG. 2, which is command mode operation. If this serial data is not detected, operation continues on FIG. 3, which is conventional mode operation.

In FIG. 2, Command Mode Operation, a Command Monitor Loop is Entered.

This command monitor loop waits for a data byte to be received, and then this data byte is compared to the supported sounds. If the data byte matches a supported sound, the appropriate sequence is sent to the sound processor, which plays the corresponding sound. If the data byte matches a supported command, the appropriate sequence is sent to the sound processor, which configures the sound processor operation. Only a representative decode is depicted in FIG. 2, showing a horn, bell, and volume control data byte decode. These commands are easily changed in the PIC processor firmware with an in-circuit programmer, and can be tailored for various command environments.

In FIG. 3, Conventional Mode Operation, a Conventional Monitor Loop is Entered.

Only a few high level functions are maintained in a monitor loop. These consist of a comparator frequency measurement for the DC offset (if present), and an analog to digital (A/D) measurement of the track voltage. This loop runs at the nominal frequency of the comparator oscillation, which ranges from 1150 us to 1350 us. The loop is paced by the rising edge of the comparator oscillation cycle. Once the rising edge is found the time to the falling edge is measured. The measurement is in 5 us increments, and this measured value is compared to the nominal no offset value locked in the non-volatile storage from the calibration sequence. When this measured value is 80 us less then the calibration value, there is a negative DC offset present. A positive DC offset is detected when the measured value is 120 us more than the calibration value. The number of times the monitor loop has found this DC offset to exist is a measurement of the time that the offset existed. This time is important for filtering noise pulses, and selecting the commanded sound to play. Once the determination of the sound is made, the appropriate command is sent to the sound processor, which plays the corresponding sound.

The other task in the conventional mode monitor loop is to read the track voltage by using the built-in A/D converter. This reading is average filtered to prevent "hunting" at thresholds that the RPM levels are adjusted. The voltage thresholds are easily changed in the PIC processor firmware with an in-circuit programmer, and are initially set to sequence the RPM levels about every 2 volts of track voltage change. When the track voltage increases, the next higher RPM level is commanded to the sound processor; likewise when the track voltage decreases, the next lower RPM level is commanded to the sound processor. The RPM levels are adjusted on the lower track voltages, reaching max revs at about ⅔ of the AC maximum; this is done as the model train is typically operated between 8 and 12 volts AC.

Depicted in FIG. 4 is the Sound Processor Firmware Monitor Loop.

It is important to note that additionally this chip also contains the digitized sounds to be played, which are encoded from industry standard ".wav" files and digitized when the sound chip is programmed. These encoded sounds are changed as needed, and programmed into the sound chip on demand. Since this sound chip is socketed, new sounds are made available to the user simply by changing this chip on the Sound Commander product.

The monitor loop checks the ports for a strobe to signify a command is present. This command could be a sound, such as a horn blast, or a command, such as setting a volume of a voice channel. The strobe for a sound to play, in comparison to a command to execute, is on a different I/O pin; so this is easily determined. After the strobe is detected, the 4-bit value is read in from the data port (port 1). This value is used to determine the course of action needed. If a sound command is requested, the voice channels are checked for idle, and once an idle channel is located, the digitized sound is played. If a command, the appropriate control register of the sound processor is modified.

The sound processor is very limited in processing capability. Unique to the Sound Commander, the sound processor firmware is able to queue up to 2 sounds before "stalling". When the sound processor stalls, the sound processor cannot read the information on the ports, which is where the commands are present to direct the operation of the sound processor. As this condition would create a loss of control it is not acceptable, so the sound processor must not "stall". When a digitized sound is played, the digitized sound data contains a "marker", this marker is used to prevent a second play command from being sent to the sound chip playback engine—which if sent would cause a "stall". If the marker is not detected, the play command is queued, not played.

The "marker" present in the digitized sound data is created when the sounds are prepared for use in the sound chip. This marker is found by trial and error, and is set to a sample number that causes the sound processor to stall, and backing off the marker by 100 samples. Sound set preparation is only done each time a new sound set released.

On a "Steam sounds set", there is a "chuff" sound requirement. This sound must be triggered by rotation of the locomotive wheels. An external switch is used for this, and is connected to a port pin for detection. In the monitor loop, when the switch closure is detected, a "chuff" sound is played.

In FIG. 5, the Present Invention Shown in the Schematic Works as Follows:

IC1 is a switching power supply. This part and associated parts provide for a regulated 5v power supply. The entire sound system runs on this 5v power supply. The schematic for the power supply is per the recommended design on the IC1 data sheet.

Components C1, D11, D10, R10, C2, and D12 form a voltage doubler for supplying a useable voltage at low track conditions. Without this doubler, the sound card would not operate at low voltages on the track, especially when DC offsets are being created. Lowering the positive_of the AC supply can generate these offsets; and without the doubler the sound card would not have enough positive voltage to regulate to 5v. The minimum voltage is 7.5v on the input of IC1. R10/D12 form a transient voltage suppressor, as the input of the IC1 is limited to 60v DC.

The input voltage on the input of IC1 can be derived thusly: Typically trains run on a max of 18-20v AC. The peak voltage is determined by 20*1.414=28.28v. This is doubled and you arrive at 56.56v DC max into the input of IC1. As the doubler is not 100% efficient, typically the voltage does not exceed 50v at the input of IC1.

The processor, IC2 is the supervisory component on the system. The serial data present on pin 2 ("RS Data") is used to determine what sound is activated in command mode. Command mode is determined by the presence of this serial signal. When absent, the system enters into conventional mode, utilizing the DC offsets to activate sounds. These modes are mutually exclusive.

The conventional mode adds complexity to the design, and requires a DC offset detector and track voltage detector. This DC offset detector is used to activate the selected sound, and the voltage detector is used to "ramp" the motor rev sounds as the loco responds to the voltage that determines the speed it moves on the track.

The Offset detector is comprised of hardware and software. R11, C10, R12, C11 form a 2 stage integrator. This converts any DC offset in the AC waveform to a smooth value that may be used to adjust a VCO (voltage controlled oscillator), comprised of IC2 and R23, R24, and C21. The base frequency is controlled by C21, and is selected to be about 800 Hz. In reality it seems the variations of the PIC comparator allow this frequency to vary from 700 Hz to 900 Hz. At first power up, the VCO is measured and an internal reference is stored in the non-volatile ram in the PIC for detection on subsequent operations.

Pin 13 of the PIC is the voltage threshold point at which the VCO can switch state from hi to low and back, thus oscillating. Note the voltage is at zero volts at R12/C11 junction with zero DC offset; R21 and R22 were selected to set the VCO to a 50% duty cycle.

With a positive or negative "influence" at R12/C11, the VCO will change the duty cycle, which is compared to the calibration value. This delta will be detected by IC2 firmware, and then an appropriate sound may be activated.

Pin 3 of IC2 is an A/D input. This analog to digital conversion is allows track voltage measurement. The voltage is peak detected, filtered, and scaled between 0v to 5 v for the input of IC2 representing the track voltages for model train operation. This is done with D14, R13, C12, R14, C13, and R15. The A/D input on IC2 pin 3 will measure 0v to 5v based on a track of 0v to 15 v, all higher voltages will be clamped by the input protection of IC2 pin3. Mapping voltage to rev rpm levels is not an exact science, and is not linear in response. Thus the intent is to step through 4 rev rpm levels from 7v to 15 v, or about every 2v of track voltage change. The thresholds have hysteresis and in firmware to prevent hunting near rpm rev change set points.

IC3 is the sound processor, and can digitize and store 2 channels (voices) of sound data. Software provided by the chip manufacturer converts industry standard ".wav" files into sound data which can be "played" by the sound chip. The firmware, unique to this design, operating on this component sequences the sounds. For example, when the horn is blown, the firmware plays an attack sound, a sustain sound, and then the decay sound. This type of control eliminates the IC2 processor from commanding each step of the sound playback. The sound processor is not very powerful, and will not respond to I/O pin control (commands) when playing.

Commands to IC3, are selected with a command set architected to activate sounds, and to set playback characteristics, such as volume settings.

Port 1 on IC3 (4 bits) is set as a data port, with 0-15 possible settings. Port 2 is the strobe select. When port 2, bit 0 is toggled, the request is a sound command, such as play the horn sound. When port 2, bit 1 is toggled, the request is a control command, like set the voice channel volume. Port 2, pin 2 and 3 allow for external sound requests, used for generating a chuff sound for a steam locomotive. See the following charts for the full command descriptions.

Command Set for Sound Selection

| COMMAND | DECIMAL CODE | ACTION |
|---|---|---|
| EM58_AUX | 1 | No sound |
| EM58_HORN | 2 | Blow Horn |
| EM58_BELL | 3 | Ring Bell |
| EM58_CPLR | 4 | Coupler Clank |
| EM58_CREW | 5 | Crew Chatter dialog |
| EM58_TOWER | 6 | Tower Chatter dialog |
| EM58_SND01 | 7 | Reserved |
| EM58_SND02 | 8 | Reserved |
| EM58_SND03 | 9 | Reserved |
| EM58_SND04 | 10 | Reserved |
| EM58_SND05 | 11 | Reserved |
| EM58_SND06 | 12 | Reserved |
| EM58_SND07 | 13 | Reserved |
| EM58_SND08 | 14 | Reserved |
| EM58_SND09 | 15 | Reserved |

Command Set for Control Operations

| COMMAND | DECIMAL CODE | ACTION |
|---|---|---|
| EM58_VOL1_OFF | 1 | Voice Channel 1 Mute |
| EM58_VOL1_LVL1 | 2 | Voice Channel 1 Volume Low |
| EM58_VOL1_LVL2 | 3 | Voice Channel 1 Volume Med |
| EM58_VOL1_LVL3 | 4 | Voice Channel 1 Volume Med Hi |
| EM58_VOL1_LVL4 | 5 | Voice Channel 1 Volume Hi |
| EM58_VOL2_OFF | 6 | Voice Channel 2 Mute |
| EM58_VOL2_LVL1 | 7 | Voice Channel 2 Volume Low |
| EM58_VOL2_LVL2 | 8 | Voice Channel 2 Volume Med |
| EM58_VOL2_LVL3 | 9 | Voice Channel 2 Volume Med Hi |
| EM58_VOL2_LVL4 | 10 | Voice Channel 2 Volume Hi |
| EM58_RPM_OFF | 11 | Motor RPM Rev's OFF |
| EM58_RPM_IDLE | 12 | Motor RPM Rev's Idle Rate |
| EM58_RPM_LOW | 13 | Motor RPM Rev's Low Rate |
| EM58_RPM_MED | 14 | Motor RPM Rev's Med Rate |
| EM58_RPM_HI | 15 | Motor RPM Rev's Hi Rate |

IC4 is a power amplifier. This part is configured to "sum" the 2 channels (voices) from the sound chip (IC3). The gains may be set by selection of R44, and currently this is about 3 times the input signal. Most importantly the "shutdown" pin in combination with OP1, R16, and C44, turn off the power amplifier soon as the power is removed. This "conserves" the charge in the voltage doubler, thus keeping IC1 from losing regulation. When IC1 does not lose regulation, the doubler circuit does not produce "kick-back"; eliminating the need for a battery in the system. Since the power is still active, the processor and sound chip still run, and retain state. Doing so does not drain the power supply quickly, and they can be left running, as the real power draw is in driving the speaker.

When power is restored, the sounds continue playing where they left off. This is great for the Bell, as typically in a switching yard, one would be interrupting the power to reverse the locomotive direction, and this is where the bell would be used. This gives a nice touch to the conventional operator (where track power is in constant flux), making the operation realistic.

In use, there are two modes of operation: "conventional mode" and "command mode". The unique features of the Sound Commander of the present invention that set it apart from current market products are as follows.

Regarding conventional mode features and operations, the Sound Commander of the present invention uses a special circuit to shut down the current draw of the power amplifier so the power supply can hold regulation for a long enough period of time (8-12 seconds) to prevent "kick-back" in this critical time.

The Sound Commander of the present invention has a very unique way to detect the positive and negative offsets. Internally to the selected PIC microprocessor a comparator is configured to oscillate. This comparator when configured as an oscillator is very non-deterministic relative to the frequency at which it will oscillate; additionally the manufacturing tolerances of the PIC add more variation. This frequency may be bounded by the use of external precision resistors and capacitors. The DC offset integrator comes into play to vary the frequency of this oscillator, forming a voltage-controlled oscillator. The uniqueness of the Sound Commander of the present invention system is such that it self calibrates on the initial power on at factory test, and thus the base frequency is measured and locked internally in non-volatile storage for later comparison against offset frequencies produced by the offset voltage to frequency conversion.

The Sound Commander of the present invention only detects a full 3v to 5v DC offset voltage, thus ignoring the fast pulses. The Sound Commander of the present invention can select additional sounds beyond horn and bell. This way this is done is during the noise filtering, a counter is maintained as to the length of the DC offset present. Below a certain count, the offset is dismissed as noise. Once the counter is over a critical count, which represents time the offset is present, to be considered a valid signal, the horn or bell is activated. This counter can also be leveraged to represent how long the horn (positive offset) or bell (negative offset) was presented as valid. If the valid time exceeds a certain point, the sound may be re-triggered or an optional sound may be activated.

The horn (positive offset) is used to repeat the horn sound; thus the horn can last longer in response to the operator request.

The bell (negative offset) is used to operate additional sounds by checking the counter when the offset is removed. This is a key point to selection of different sounds. While current products sounds in prior art devices are triggered by creation of the offset, the Sound Commander of the present invention negative detector activates the sound on removal of the offset. Thus the time of the press may be measured. To be effective the timing is measured in seconds, and has a practical limit of one, possibly 2 alternate sounds; it is sufficient to provide additional sound selections. For example: when the Bell (negative offset) is 2 seconds or less, the Bell operates. When the offset lasts greater than 2 seconds but less than 3 seconds, the first alternate sound operates. When the offset lasts greater than 3 seconds, the second alternate sound operates. This take a bit of getting used to by the operator, but is a learned behavior to release the button to hear the bell (or alternate sound).

Command mode operation in the Sound Commander of the present invention may be initiated in two ways. The first is to simply trigger sounds, one per I/O pin state change. This is a match up to the NMRA DCC decoders. These Decoders change an I/O pin state based on the sound they wish to activate. These outputs are tied into the input pins of the Sound Commander of the present invention and are used to activate the requested sound. In the AC train market, the sound control data is provided in serial format per the Lionel TMCC specification. This serial data is used to activate the particular sound based on the 8-bit data byte value. Since volume related commands are part of the data packet, this affords a bit more creativity to the system behavior. The ability to lower the volume on the individual sounds opens an opportunity to optimize the sound generation. The Sound Commander of the present invention delivers the motor rev sounds on one channel, and either horn or bell on the second channel so that the horn and bell are mutually exclusive.

The Sound Commander of the present invention employs "Dynamic Sound Mapping™"; this feature moves the sounds between channels dynamically based on volume settings. If the motor rev sounds are lowered to non-audible levels, the bell is dynamically moved to the audio channel the motor rev sounds were on. This mode of operation is a desirable characteristic, as many operators grow tired of the motor rev sounds constantly playing. Thus moving the horn and bell on separate channels when the motor revs are not active allows both the horn and bell to play concurrently.

It is understood that the preceding description is given merely by way of illustration and not in limitation of the invention and that various modifications may be made thereto without departing from the spirit of the invention as claimed.

What is claimed is:

1. A sound system for model trains and accessories, the system comprising:

an electronic sound chip for storing digitized sounds, the sound chip containing a sound processor for producing sound from at least one of the voice channels in the sound chip;

a microprocessor comprising an internal comparator operating as a voltage controller oscillator, the microprocessor controlling sound chip operation using the comparator to detect variable DC offsets, input by a user, by a voltage to frequency conversion and measurement process and thereby activating one of the voice channels in the sound chip, which the microprocessor self-calibrates on an initial power on of the system to measure a base frequency which is locked internally in a non-volatile storage for later comparison by the comparator against DC offset to frequency conversion;

wherein an opto-coupler shuts down a power amp to preserve power to allow firmware to remain operational in both the microprocessor and the sound processor; permitting sound generation to resume through brief power interruptions and to prevent "kick-back" that could create a malfunction of standard reversing electronics in locomotives.

2. A sound system for model trains and accessories, the system comprising:

an electronic sound chip for storing digitized sounds, the sound chip containing a sound processor for producing sound from at least one of the voice channels in the sound chip;

a microprocessor comprising an internal comparator operating as a voltage controller oscillator, the microprocessor controlling sound chip operation using the comparator to detect variable DC offsets, input by a user, by a voltage to frequency conversion and measurement process and thereby activating one of the voice channels in the sound chip, which the microprocessor self-calibrates on an initial power on of the system to measure a base frequency which is locked internally in a non-volatile storage for later comparison by the comparator against DC offset to frequency conversion;

wherein the microprocessor measures a negative DC offset length caused by user bell button activation length to measure the bell button release and select a sound based on the bell button activation length, wherein the microprocessor measures the same bell button activation length to activate a bell by normal bell button usage which is less than 2 seconds.

3. A sound system for model trains and accessories, the system comprising:

an electronic sound chip for storing digitized sounds, the sound chip containing a sound processor for producing sound from at least one of the voice channels in the sound chip;

a microprocessor comprising an internal comparator operating as a voltage controller oscillator, the microprocessor controlling sound chip operation using the comparator to detect variable DC offsets, input by a user, by a voltage to frequency conversion and measurement process and thereby activating one of the voice channels in the sound chip, which the microprocessor self-calibrates on an initial power on of the system to measure a base frequency which is locked internally in a non-volatile storage for later comparison by the comparator against DC offset to frequency conversion;

wherein the sound processor dynamically allocates voice channels to play as many concurrent sounds as possible in two-channels to allow realistic sounds so that when the rpm sounds are on channel 2, and the bell is on channel 1, playing the horn would stop the bell, and blow the horn on channel 1 and so that when the rpm sounds are silenced, the bell is moved to channel 2, thus playing the horn on channel 1 will be concurrent.

4. A sound producing method for model trains, the method comprising:

using a processor to control an electronic sound chip storing digitized sounds, the sound chip containing a sound processor for producing sound from at least one of the voice channels in the sound chip;

the processor using an internal comparator present in the processor operating as a voltage controlled oscillator, the processor controlling the sound chip operation by detecting variable DC offsets, input by a user, by a voltage to frequency conversion and measurement process and thereby activating one of voice channels in the sound chip, which the processor self-calibrates on an initial power of the system to measure the base frequency which is locked internally in a non-volatile storage for later comparison by the comparator against DC offset to frequency conversion; and having an opto-coupler shut down a power amp to preserve power to allow main processing to remain operational in both the processor and the sound processor; permitting sound generation to resume through brief power interruptions and to prevent kick-back that could create a malfunction of standard reversing electronics in locomotives.

5. A sound producing method for model trains, the method comprising:

using a processor to control an electronic sound chip storing digitized sounds, the sound chip containing a sound processor for producing sound from at least one of the voice channels in the sound chip;

the processor using an internal comparator present in the processor operating as a voltage controlled oscillator, the processor controlling the sound chip operation by detecting variable DC offsets, input by a user, by a voltage to frequency conversion and measurement process and thereby activating one of voice channels in the sound chip, which the processor self-calibrates on an initial power of the system to measure the base frequency which is locked internally in a non-volatile storage for later comparison by the comparator against DC offset to frequency conversion; and the processor measuring a negative DC offset length caused by user bell button activation length to measure the bell button release and select a sound based on the bell button activation length, wherein the processor measures the same bell button activation length to activate a bell by a normal bell button usage which is less than 2 seconds.

6. A sound producing method for model trains, the method comprising:

using a processor to control an electronic sound chip storing digitized sounds, the sound chip containing a sound processor for producing sound from at least one of the voice channels in the sound chip;

the processor using an internal comparator present in the processor operating as a voltage controlled oscillator, the processor controlling the sound chip operation by detecting variable DC offsets, input by a user, by a voltage to frequency conversion and measurement process and thereby activating one of voice channels in the sound chip, which the processor self-calibrates on an initial power of the system to measure the base frequency which is locked internally in a non-volatile storage for later comparison by the comparator against DC offset to frequency conversion; and the sound processor dynamically allocating voice channels to play as many concurrent sounds as possible in two channels to allow realistic sounds so that when the rpm sounds are on channel 2, and the bell is on channel 1, playing the horn would stop the bell, and blow the horn on channel 1 and so that when the rpm sounds are silenced, the bell would be moved to channel 2, thus playing the horn on channel 1 will be concurrent.

7. A sound system for a model train, comprising:

a sound device comprising an amplifier, at least one speaker, and a storage device for storing a plurality of sounds; and a processor comprising a non-volatile memory and a comparator configured to function as a voltage controlled oscillator, said processor being programmed to:

detect an initial power-up;

measure a first frequency at which said comparator oscillates once in response to said initial power-up, said first frequency representing a base frequency;

store said first frequency in said non-volatile memory;

detect a subsequent power-up;

measure a second frequency at which said comparator oscillates after said subsequent power-up, said second frequency representing at least a DC offset initiated by a user of said model train;

compare said second frequency with said first frequency stored in said non-volatile memory to detect said DC offset; and send a command corresponding to said DC offset to said sound device, said command identifying one of said plurality of sounds that are stored in said storage device;

wherein said sound device is configured to receive said command and in response thereto, retrieve said one of said plurality of sounds from said storage device and play said one of said plurality of sounds on said at least one speaker, said at least one speaker being powered by said amplifier.

8. The sound system of claim 7, wherein said processor is further programmed to measure said first frequency in response to said initial power-up, after said voltage controlled oscillator stabilizes.

9. The sound system of claim 8, wherein said processor is further programmed to measure said second frequency after said subsequent power-up, and after said user initiates said DC offset.

10. The sound system of claim 7, wherein said processor is further programmed to measure said second frequency after said subsequent power-up, and after said user initiates said DC offset.

11. The sound system of claim 7, wherein said plurality of sounds comprises at least a horn sound and a bell sound.

12. The sound system of claim 11, wherein said plurality of sounds further comprises as least one of a motor revolution sound, a brake compressor sound, a coupler clank sound, a whistle sound, a steam hiss sound and a steam chuff sound.

13. The sound system of claim 7, wherein said processor is further programmed to measure a length of said DC offset, wherein said command further corresponds to said length of said DC offset.

14. A sound system for a model train, comprising:

a sound device comprising an amplifier, at least one speaker, and a storage device for storing a plurality of sounds; and a processor comprising a non-volatile memory and a comparator configured to function as a voltage controlled oscillator, said processor being programmed to:

measure a first frequency at which said comparator oscillates, said first frequency representing a base frequency;

store said first frequency in said non-volatile memory;

measure a second frequency at which said comparator oscillates, said second frequency representing at least a DC offset initiated by a user of said model train;

compare said second frequency with said first frequency stored in said non-volatile memory to detect said DC offset; and send a command corresponding to said DC offset to said sound device, said command identifying one of said plurality of sounds that are stored in said storage device; and a circuit for deactivating said amplifier in response to a power-down of said system and activating said amplifier in response to a power-up of said system, thereby reducing "kick-back" malfunctions due to power interruptions;

wherein said sound device is configured to receive said command and in response thereto, retrieve said one of said plurality of sounds from said storage device and play said one of said plurality of sounds on said at least one speaker, said at least one speaker being powered by said amplifier.

* * * * *